United States Patent [19]

Cherepy, Sr.

[11] Patent Number: 4,967,427

[45] Date of Patent: Nov. 6, 1990

[54] PATIENT CONVEYOR ASSEMBLY

[76] Inventor: Louis S. Cherepy, Sr., 5205 Jo St., Zephyrhills, Fla. 33541

[21] Appl. No.: 451,120

[22] Filed: Dec. 14, 1989

[51] Int. Cl.[5] ..... A61G 7/08

[52] U.S. Cl. ..... 5/81 C; 5/81 B

[58] Field of Search ..... 5/81 B, 81 C, 81 R, 5/82; 198/860.1, 860.2, 860.3

[56] References Cited

U.S. PATENT DOCUMENTS

| | | | |
|---|---|---|---|
| 2,903,043 | 9/1959 | Kenney | 5/81 B |
| 2,918,681 | 12/1959 | Davis | 5/81 C |
| 2,984,842 | 5/1961 | Richards | 5/82 |
| 3,418,670 | 12/1968 | Morgan | 5/81 C |
| 3,541,617 | 11/1970 | Clanan | 5/81 B |
| 3,639,929 | 2/1972 | Steelman | 5/81 C |
| 3,792,500 | 2/1974 | Swara, Sr. | 5/81 B |
| 4,051,565 | 10/1977 | Berge | 5/81 B |
| 4,087,873 | 5/1978 | Ohkawa | 5/81 B |
| 4,297,753 | 11/1981 | Langren | 5/81 C |
| 4,369,533 | 1/1983 | Gisiger | 5/81 C |
| 4,667,355 | 5/1987 | Nishijima | 5/82 R |
| 4,891,851 | 1/1990 | Sierocuk et al. | 5/81 R |

*Primary Examiner*—Eric K. Nicholson
*Assistant Examiner*—Michael J. Milano
*Attorney, Agent, or Firm*—Hoffmann & Baron

[57] ABSTRACT

A generally flat, portable and light weight patient conveyor assembly is provided. The assembly includes an elongate base including a bottom wall and opposing side and end walls. A plate-like support is pivotably mounted to one of the side walls and may be moved into locking engagement with the other of the side walls. An endless belt is positioned about the plate-like support. In an alternative embodiment of the present invention, the endless belt conveyor is replaced by a set of parallel rollers.

22 Claims, 3 Drawing Sheets

PATIENT CONVEYOR ASSEMBLY

BACKGROUND OF THE INVENTION

1. Field of the Invention

The field of the invention relates to assemblies for transporting patients from one support surface to another.

2. Brief Description of the Prior Art

The difficulties of moving patients from a hospital bed to another bed, a chair or other support are well recognized. A paralyzed or otherwise incapacitated person is particularly difficult to move.

Various machines and devices have been proposed for facilitating patient transfer. U.S. Pat. Nos. 4,297,753, 4,776,047 and 4,794,655 disclose various conveyors for moving patients between two points. Each of these conveyors is fairly complex. U.S. Pat. No. 4,297,753 discloses a conveyor including a plurality of parallel rollers. This conveyor may be folded in half for storage.

A patient may also be moved between two points through the use of a board extending therebetween. Such boards are often constructed to have narrow ends to fit beneath the patient and a wide center portion to provide strength and support. Talcum powder may be provided on the board for lubrication. This method has a number of drawbacks, however, including excessive friction between the patient and the board. The problem is magnified if the patient is not fully clothed.

SUMMARY OF THE INVENTION

It is an object of the invention to provide a patient conveyor assembly which is light in weight and suitable for use in homes or hospitals.

It is another object of the invention to provide a patient conveyor assembly which can be used as a conveyor or as a board.

A still further object of the invention is to provide a patient conveyor assembly which facilitates patient transfer without undue discomfort to the patient.

In accordance with these and other objects of the invention, a patient conveyor assembly is provided which includes a base, the base preferably including a substantially smooth bottom surface, and conveying means mounted to said base, said conveying means including moving means defining a top surface, said top surface and said bottom surface defining opposite sides of said conveyor assembly.

The conveyor assembly preferably has a substantially rectangular configuration and is relatively small in height. The moving means preferably include an endless belt trained about a belt support. The belt support may include a substantially flat plate which is generally parallel to the bottom surface. The plate may be pivotably mounted to the base in order to facilitate installation and removal of the belt.

A pair of end walls may be formed with or mounted to each end of the base. Each block is positioned a small distance from an end of the belt support. The belt extends through slots defined by the opposing ends of the belt support and the respective end blocks.

DETAILED DESCRIPTION OF THE INVENTION

A patient conveyor assembly 10 is provided. The assembly 10 includes a base 12, a belt support 14 removably secured to the base 12, and an endless belt 16 trained about the support 14. The base and support are preferably molded from a high strength plastic material, but could alternatively be fabricated from wood or metal. The belt 16 can be made from a fabric such as canvas or any other flexible material which does not tend to irritate the skin.

Figure 1:
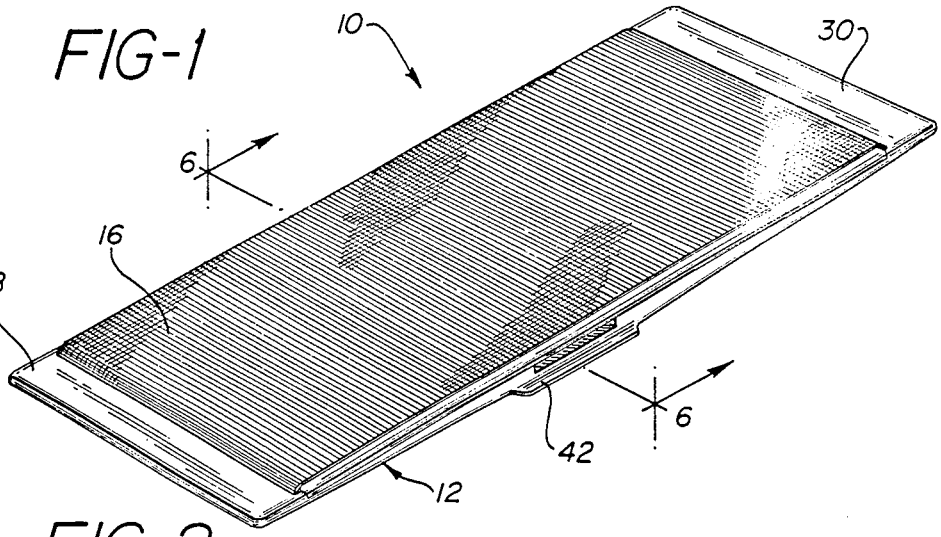
FIG. 1 is a perspective view of a patient conveyor assembly according to the invention.
Figure 2:
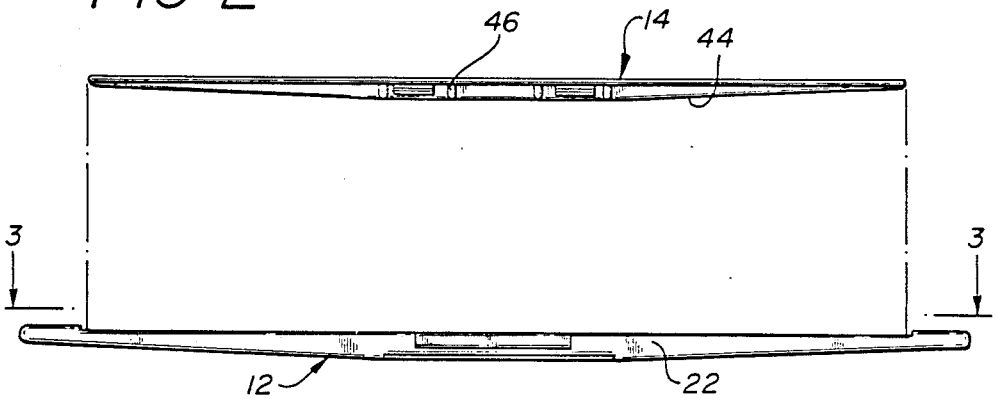
FIG. 2 is an exploded, side elevation view of the patient conveyor assembly without an endless belt.
Figure 3:
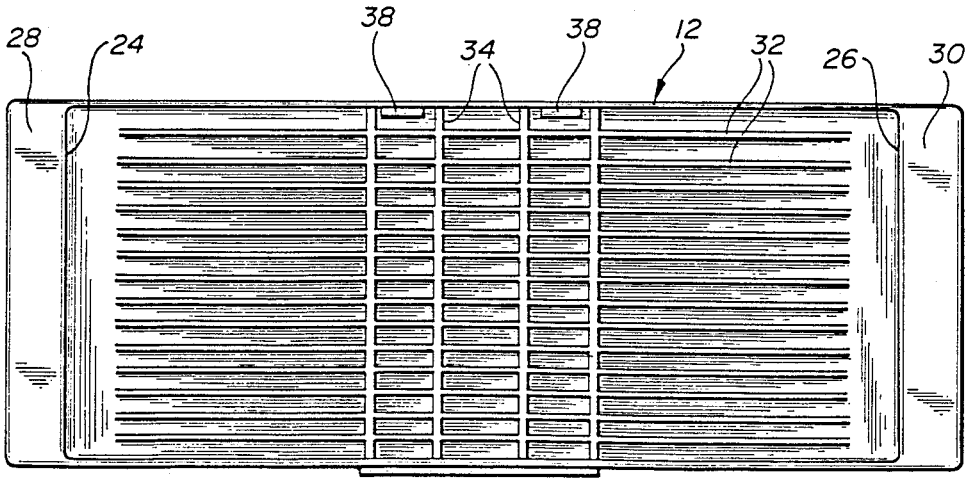
FIG. 3 is a top plan view of the base of said assembly.

Referring to FIGS. 1 and 2, the assembly 10 preferably is somewhat crescent-shaped, being about three quarters to two inches thick in the middle and about three eighths to one half inch thick at each end. This allows it to be easily slipped under a patient, yet provides the requisite strength for supporting the patient between two points. The maximum thickness of the assembly should not exceed about two inches.

As shown in FIGS. 2-6, the base 12 is of integral construction. It includes a bottom wall 18, a pair of side walls 20, 22, and a pair of opposing end walls 24, 26. The end walls 24, 26 are each several inches wide, and provide a pair of substantially flat, upper surfaces 28, 30. The end walls, side walls and bottom wall of the base define a shallow cavity.

The base 12 is strengthened by the presence of rows of longitudinal and transverse ribs 32, 34 projecting upwardly from the bottom wall 18. The longitudinal ribs diminish in height near the end walls 24, 26 to compensate for the decreasing height of the base 12 near these walls.

Figure 4:
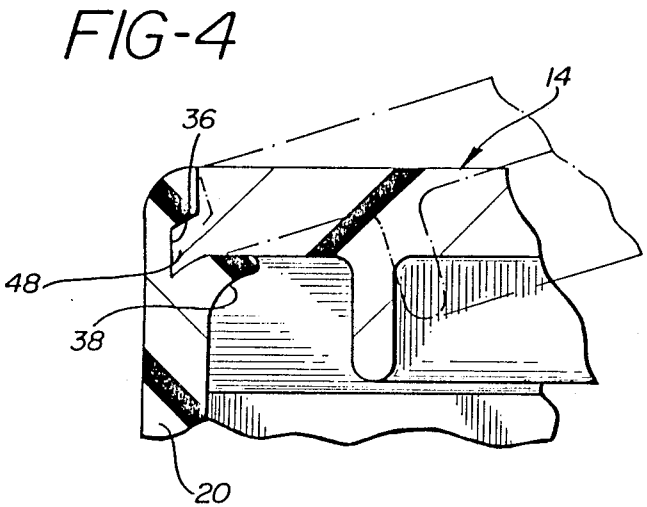
FIG. 4 is an enlarged sectional view of a hinge portion of said assembly.
Figure 6:
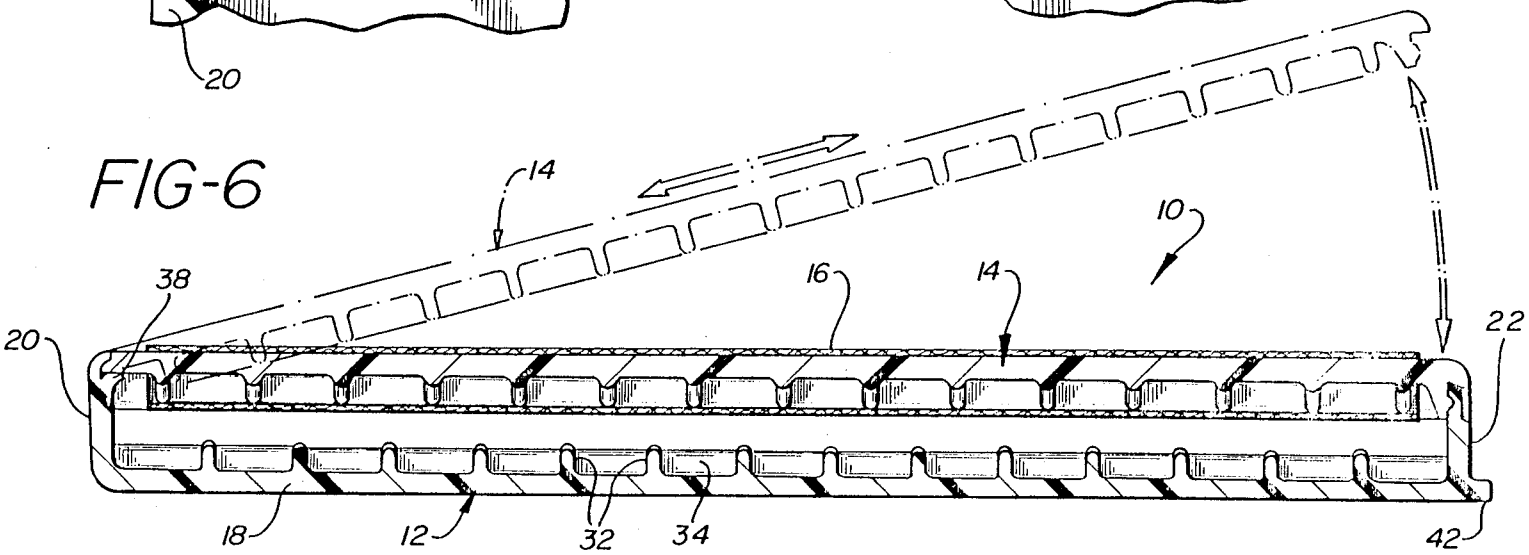
FIG. 6 is a sectional view of the assembly taken along line 6—6 of FIG. 1.

Referring to FIGS. 4 and 6, one of the side walls 20 of the base includes a pair of notches 36 and a pair of lips 38 protruding inwardly beneath the respective notches. The lips 38 each have a smooth, curved upper surface.

Figure 5:
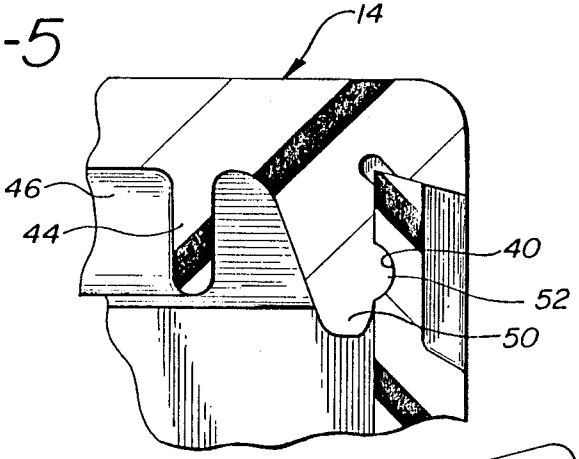
FIG. 5 is an enlarged, sectional view of a latch portion of said assembly.

Referring to FIGS. 5 and 6, the other of the side walls 22 of the base includes a semicylindrical groove 40. The side wall 22 is relatively thin in this area to provide greater flexibility. It is thicker elsewhere to provide strength. A lip 42 projects outwardly from the side wall beneath the notched area described above. Downward pressure on the lip will cause the side wall 22 to flex outwardly to allow the belt support 14 to be disengaged in the manner described below.

The belt support 14 is a generally plate-like structure suspended above and generally parallel to the bottom wall of the base 12. It includes rows of longitudinal and transverse ribs 44, 46 extending from its lower surface. The longitudinal ribs 44, like ribs 32, decrease in height from the center to the ends of the belt support 14. Referring to FIGS. 4 and 6, one longitudinal edge of the belt support 14 includes a pair of protruding flanges 48 which fit, respectively, within the notches 36 in the side wall 20 of the base 12. The opposite edge of the belt support 14 is defined by a pair of downwardly extending projections 50, each of these projections including a semicylindrical ridge 52. The ridges 52 fit within the semicircular groove 40 within the side wall 22 of the base.

Figure 7:
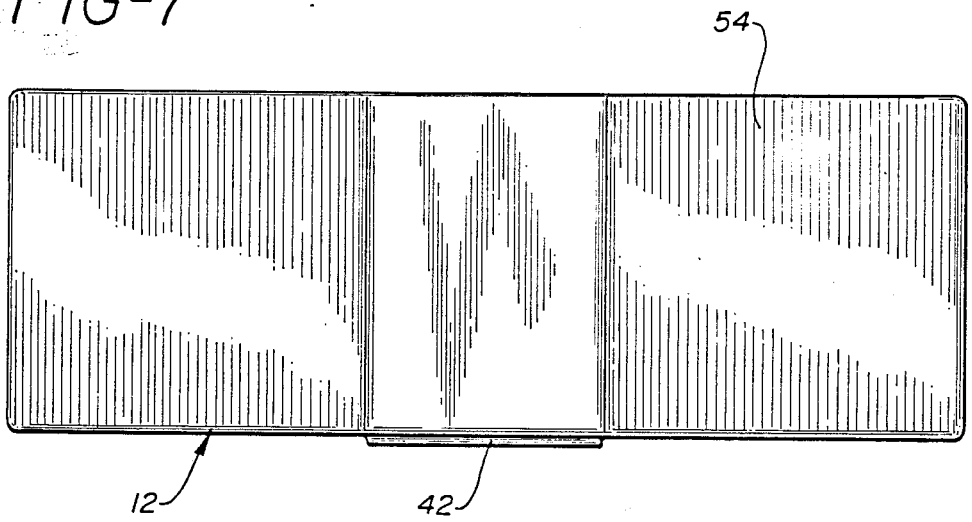
FIG. 7 is a bottom plan view of the assembly.

The bottom surface 54 of the base 12, as best shown in FIG. 7, may be smooth as shown in order to use the assembly 10 as a conventional board. The assembly would simply be flipped upside down to be used in this manner. Alternatively, a rough bottom surface could be employed to prevent the assembly from sliding upon the surfaces which support it.

Figure 8:
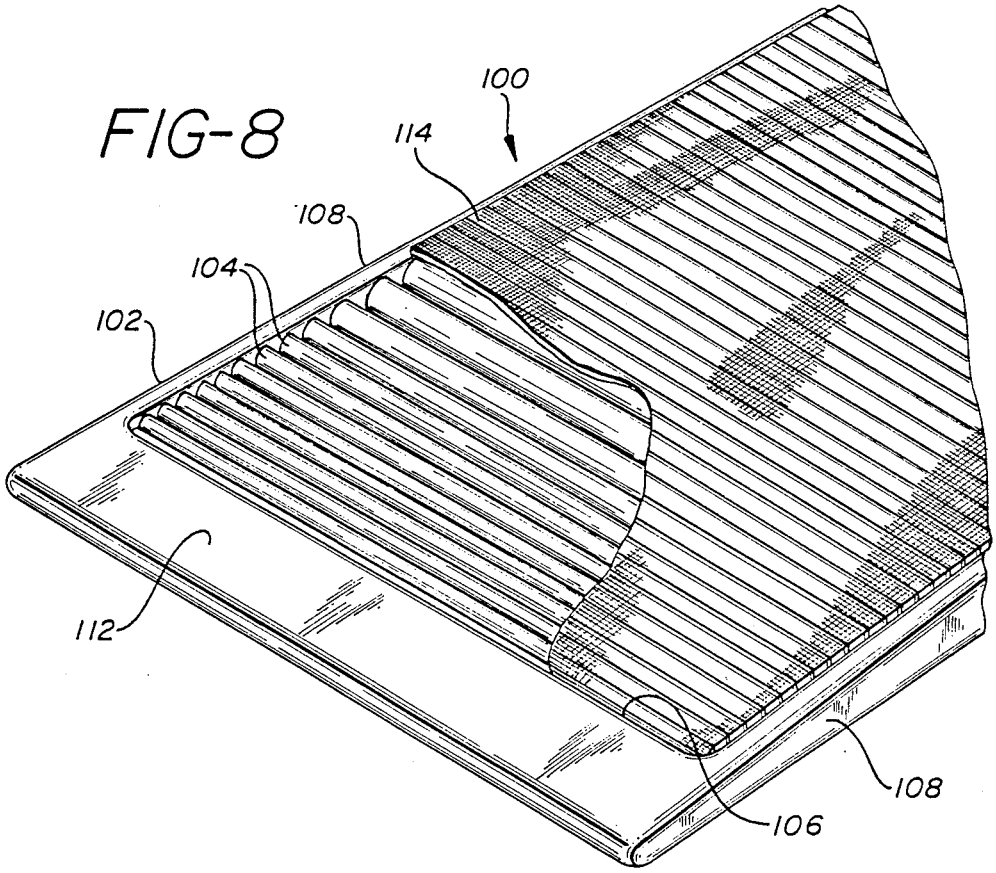
FIG. 8 is a perspective view of an alternative embodiment of the invention.

An alternative embodiment of the invention is shown in FIG. 8. A conveyor assembly 100 including a base 102 and a plurality of closely spaced, parallel rollers 104 supported by the base 102 is provided. The base includes a pair of end walls 106, a pair of side walls 108, and a bottom wall 110. The walls define a cavity within which the rollers 104 are positioned. The end walls 106 of the base 102 are relatively wide, and include a smooth upper surface 112. The ends of the assembly are relatively narrow compared to the middle to facilitate moving it beneath a patient. An endless belt 114 may be mounted to the rollers 104 to prevent possible pinching when a patient is transported between two points.

Both embodiments of the invention are employed in substantially the same way. The patient's body is tilted to one side, and one end of the conveyor assembly is moved under the patient. The other end of the conveyor assembly rests upon the surface to which the patient is being transported. The patient, with the assistance of another person, is then moved across the conveyor portion of the assembly and onto the support surface. The patient's body is again tilted so that the assembly can be removed. The conveyor assemblies shown in both embodiments of the invention are relatively compact and light in weight. An assembly width of less than eighteen inches, and preferably nine to twelve inches, is sufficient for transporting most patients. The length may be two to three feet, which is sufficient to traverse most adjacent support surfaces. The entire assembly weighs less than about six pounds, which makes it easy to use and transport.

The endless belt 16 is easily removed from the assembly 10 should it require cleaning, repair or replacement. The user simply presses down upon the lip 42 of the base 12, causing the side wall 22 to flex outwardly. By slipping one's fingers beneath the overhanging portion of the belt support 14 in the area where the side wall 22 is relatively thin, the semicylindrical ridge 52 can be displaced from the semicylindrical groove 40 as upward pressure is exerted upon the belt support. The belt support can then be pivoted about the hinge assembly (36, 38, 48) as shown in FIG. 6, or completely detached from the base. The belt is then removed without difficulty.

A new belt may be slipped over the belt support 14 prior to pivoting the support downwardly into locking engagement with the base 12, as shown in FIG. 5.

In order to replace the endless belt 114 shown in FIG. 8, one of the side walls may be removable from the remainder of the assembly.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. a generally flat, portable patient conveyor assembly comprising:

an elongate base including a bottom wall;

a belt support pivotably mounted to said base, said belt support including a plate-like support suspended above and generally parallel to said bottom wall of said elongate base;

first and second end walls mounted to opposite ends of said base;

a space defined between each of said end walls and said plate-like support; and an endless belt extending about said plate-like support and movable with respect to said support, said endless belt extending through each of said spaces.

2. An assembly as described in claim 1 wherein said assembly has a maximum thickness of less than about two inches, a length of three feet or less, and a width of eighteen inches or less.

3. An assembly as defined in claim 1 wherein each of said end walls includes a wide, flat upper surface.

4. An assembly as defined in claim 3 wherein said belt support is detachably mounted to said base.

5. An assembly as defined in claim 1 including means for locking said belt support to said base.

6. An assembly as defined in claim 5 wherein said means for locking include a projection extending from one of said belt support and said base, and a recess formed within one of said belt support and said base, said projection being insertable within said recess.

7. An assembly as defined in claim 1 including a pair of side walls secured to said base and extending between said end walls, said side walls, said end walls, and said bottom wall of said base defining an elongate cavity.

8. An assembly as defined in claim 7 wherein said base, said side walls and said end walls are of integral construction.

9. An assembly as defined in claim 7 wherein said assembly has a generally crescent-shaped configuration.

10. A generally flat, portable, light weight patient transport assembly comprising:

an elongate base including a bottom wall;

a pair of opposing side walls mounted to said base;

a pair of opposing end walls mounted to said base; said bottom wall, said side walls and said end walls defining a cavity; and a conveyor assembly mounted to said side walls and extending above said bottom wall, said conveyor assembly including a plate-like support pivotably secured to said base and an endless belt mounted to said support.

11. A transport assembly as defined in claim 10 wherein said conveyor assembly includes a plate-like support and an endless belt mounted to said support.

12. A transport assembly as defined in claim 10 wherein said base, said side walls and said end walls are of integral construction.

13. A transport assembly as defined in claim 10 wherein said plate-like support is detachably secured to said base.

14. A transport assembly as defined in claim 10 wherein said transport assembly has a generally crescent-shaped configuration.

15. A transport assembly as defined in claim 10 wherein said conveyor assembly includes a plurality of parallel rollers.

16. A substantially flat, portable, light weight patient conveyor assembly comprising:

an elongate base including a pair of opposing side walls;

a belt support mounted to said base, said belt support including a plate-like support;

an endless conveyor belt extending about said plate-like support and moveable in a longitudinal direction with respect to said base; and means mounted on said plate-like support for releasably securing said plate-like support to one of said side walls of said base such that said belt support can be quickly and easily released from said base, thereby allowing said conveyor belt to be slidably removed from said plate-like support.

17. An assembly as defined in claim 16 including a pair of end walls mounted to said base, said conveyor belt extending between said end walls.

18. A generally flat, portable patient conveyor assembly comprising;

an elongate base including a bottom wall;

a belt support mounted to said base, said belt support including a plate-like support suspended above and generally parallel to said bottom wall of said elongate base;

first and second end walls mounted to opposite ends of said base;

a space defined between each of said end walls and said plate-like support;

a pair of side walls secured to said base and extending between said end walls, said side walls, said end walls, and said bottom wall of said base defining an elongate cavity, said belt support being pivotably secure to one of said side walls; and an endless belt extending about said plate-like support and movable with respect to said plate-like support.

19. An assembly as described in claim 18 wherein said belt is movable about said plate-like support in a longitudinal direction with respect to said elongate base.

20. A substantially flat, portable, crescent-shaped, light weight patient transport assembly having a maximum thickness of less than about two inches and a length of three feet or less comprising:

a substantially flat, elongate base;

a substantially flat, elongate conveyor assembly mounted to said elongate base, said elongate conveyor assembly including means for conveying a patient in a longitudinal direction with respect to said base and means for rigidly supporting a patient seated upon said conveyor assembly;

said elongate base including first and second end portions, said end portionS capable of supporting said base without interfering with the operability of said conveyor assembly.

21. An assembly as described in claim 20 wherein said conveyor assembly is releasably secured to said base.

22. As assembly as described in claim 20 wherein said conveyor assembly is pivotably secured to said base.

* * * * *